United States Patent [19]

Wotier et al.

[11] Patent Number: 4,737,386

[45] Date of Patent: Apr. 12, 1988

[54] TEXTILE COATING COMPOSITION AND TEXTILES COATED THEREWITH

[75] Inventors: Edward Wotier, Greer; David Lunsford, Mauldin, both of S.C.; Howard Katz, Hightstown, N.J.

[73] Assignee: National Starch and Chemical Corporation, Bridgewater, N.J.

[21] Appl. No.: 905,354

[22] Filed: Sep. 8, 1986

[51] Int. Cl.[4] ..... B05D 3/02

[52] U.S. Cl. ..... 427/389.9; 521/555

[58] Field of Search ..... 427/389.9; 428/95, 96, 428/532; 524/555

[56] References Cited

U.S. PATENT DOCUMENTS

| | | | |
|---|---|---|---|
| 3,345,318 | 10/1967 | Lindemann et al. | 260/29.6 |
| 3,483,171 | 12/1969 | Kuhlkamp | 260/80.6 |
| 3,708,444 | 1/1973 | Ganzler | 260/2.5 |
| 3,714,096 | 1/1973 | Biale | 524/555 |
| 3,734,870 | 5/1973 | Schroeder | 260/2.5 |
| 3,755,237 | 8/1973 | Isaacs et al. | 526/324 |
| 3,900,663 | 8/1975 | Barabas et al. | 427/389.9 |
| 3,933,691 | 1/1976 | Lindemann | 260/2.5 L |
| 3,950,302 | 4/1976 | Rauterkus | 524/555 |
| 4,001,158 | 1/1977 | Lindemann | 260/29.6 TA |
| 4,044,197 | 8/1977 | Wiest et al. | 526/304 |
| 4,073,779 | 2/1978 | Wiest et al. | 260/79.3 MU |
| 4,187,353 | 2/1980 | Schroeder | 521/149 |
| 4,239,563 | 12/1980 | Iacoviello | 524/555 |
| 4,322,516 | 3/1982 | Wiest et al. | 526/307.7 |
| 4,446,274 | 5/1984 | Okazaki | 524/812 |
| 4,510,274 | 4/1985 | Okazaki | 523/411 |
| 4,542,182 | 9/1985 | Schuppiser et al. | 524/563 |
| 4,610,920 | 9/1986 | Mudge et al. | 428/288 |

FOREIGN PATENT DOCUMENTS

| | | | |
|---|---|---|---|
| 1188635 | 4/1970 | United Kingdom | 526/324 |

*Primary Examiner*—Thurman K. Page
*Assistant Examiner*—L. R. Horne
*Attorney, Agent, or Firm*—Ellen T. Dec; Edwin M. Szala

[57] ABSTRACT

Woven pile fabrics, particularly upholstery fabrics and corduroy, characterized by a superior balance of strength and softness are backcoated utilizing an aqueous emulsion prepared by the emulsion polymerization of: 30 to 50% by weight of a vinyl ester of an alkanoic acid; 10 to 30% by weight ethylene; 30 to 50% by weight of a $C_4$–$C_8$ alkyl acrylate; 1 to 5% by weight of copolymerizable N-methylol containing monomer; 0 to 4% by weight of an olefinically unsaturated carboxylic acid and 0 to 1% by weight of a polyethylenically unsaturated comonomer.

6 Claims, No Drawings

TEXTILE COATING COMPOSITION AND TEXTILES COATED THEREWITH

BACKGROUND OF THE INVENTION

Coatings, backcoatings and finishes are applied to pile type woven fabrics such as corduroy, tufted upholstery, etc., for a variety of reasons, in particular to stabilize the fibers during processing as well as to produce a fabric of improved hand, integrity, pile retention, durability and abrasion resistance to the face of the fabric. In most cases, it is important that the coating be durable under laundering conditions encountered utilizing water or dry cleaning procedures. In particular, these woven-pile fabrics have an extra set of warp or filling yarns interlaced with the basic fabric in such a manner that loops or cut ends are produced on the surface of the fabric. If the resultant loosely bound fibers are not backcoated with an adhesive or binder, the pile will not remain in the fabric during subsequent processing and certainly not after any subsequent laundering.

The introduction of N-methylol containing comonomers into the latex polymers used as binders in these backcoatings has been proposed in order to improve their laundering durability properties. N-methylol containing acrylic latices have generally been used as binders where softness is the most important criteria, to give a good balance of softness and strength, especially in the areas of pluck strength, seam slippage, pile retention and abrasion resistance, however these acrylic binders are relatively high in cost. More economical polymers such as ethylene/vinyl acetate-based binders containing N-methylol comonomers such as are disclosed in U.S. Pat. No. 3,380,851 issued Apr. 30, 1968 to M. K. Lindemann et al., yield the necessary strength properties but are deficient in the areas of softness and drape.

SUMMARY OF THE INVENTION

We have found that latex binders for use in back coating pile fabrics can be prepared by the emulsion polymerization of a vinyl ester of an alkanoic acid interpolymerized with 10 to 30% by weight ethylene; 30 to 50% by weight of a $C_4$–$C_8$ alkyl acrylate; 1 to 5% by weight of a copolymerizable N-methylol containing monomer; 0 to 4% by weight of an olefinically-unsaturated carboxylic acid containing 3 to 6 carbon atoms and 0 to 1% by weight of a polyolefinically unsaturated comonomer.

Surprisingly, pile fabrics coated with these binders possess the desirable softness characteristic of binders containing high acrylate content, combined with improvements in the areas of pluck strength, abrasion resistance, seam slippage and pile retention.

In an alternate embodiment of the invention, and particularly in the case of pile fabrics intended for upholstery, a small amount of an N-methylol containing thermoset polymer such as melamine formaldehyde condensate is post-added to the emulsion in an amount of 0.5 to 5%. When utilizing these thermosets, smaller amounts of the N-methylol containing monomer are required to achieve comparable strength. As an example, conventional binders for use in specific applications where wet strength is important require 2–5% N-methylol containing monomers such as N-methylol acrylamide (NMA); when thermosets are used comparable results may be obtained with only about 0.5–2% NMA. Since NMA increases the stiffness of the fabric, these lower NMA levels are advantageous because they provide comparable strength with a softer product than could be obtained at the higher levels.

DESCRIPTION OF THE PREFERRED EMBODIMENTS

The vinyl esters utilized herein are the esters of alkanoic acids having from one to about 13 carbon atoms. Typical examples include: vinyl formate, vinyl acetate, vinyl propionate, vinyl butyrate, vinyl isobutyrate, vinyl valerate, vinyl 2-ethyl-hexanoate, vinyl isooctanoate, vinyl nonoate, vinyl decanoate, vinyl pivalate, vinyl versatate, etc. Of the foregoing, vinyl acetate is the preferred monomer because of its ready availability and low cost.

The N-methylol component is generally N-methylol acrylamide although other mono-olefinically unsaturated compounds containing an N-methylol group and capable of copolymerizing with ethylene and the vinyl ester may also be employed. Such other compounds include, for example, N-methylol methacrylamide or lower alkanol esters thereof, or mixtures thereof.

The alkyl acrylates used herein are those containing 4 to 8 carbon atoms in the alkyl group and include butyl, hexyl, 2-ethyl hexyl and octyl acrylate. The corresponding methacrylates may also be used herein as may mixtures of any of the above.

The olefinically-unsaturated carboxylic acids which may optionally be present, are the alkenoic acids having from 3 to 6 carbon atoms or the alkenedioic acids having from 4 to 6 carbon atoms, like acrylic acid, methacrylic acid, crotonic acid, itaconic acid, maleic acid or fumaric acid, or mixtures thereof in amounts sufficient to provide up to about 4% by weight, preferably 1 to 2.5 of monomer units in the final copolymer.

Optionally, polyunsaturated copolymerizable monomers may also be present in small amounts, i.e., up to about 1% by weight. Such comonomers would include those polyolefinically-unsaturated monomers copolymerizable with vinyl acetate and ethylene, such as lower alkenyl lower alkenoates, for example, vinyl crotonate, allyl acrylate, allyl methacrylate; di-lower alkenyl alkanedioates, for example, diallyl maleate, divinyl adipate, diallyl adipate; dilower alkenyl benzenedicarboxylates, for example, diallyl phthalate; lower alkanediol di-lower alkenoates, for example, ethylene glycol diacrylate, ethylene glycol dimethacrylate, butanediol dimethacrylate; lower alkylene bis-acrylamides and lower alkylene bis-methacrylamides, for example, methylene bis-acrylamide; triallyl cyanurate, etc. In addition, certain copolymerizable monomers which assist in the stability of the copolymer emulsion, e.g., 2-acrylamide-2-methylpropane sulfonic acid and vinyl sulfonic acid, are also useful herein as latex stabilizers. These optionally present monomers, if employed, are added in very low amounts of from 0.1 to about 2% by weight of the monomer mixture.

Batch, semi-batch or slow addition methods may be used to prepare the emulsion polymers utilized herein. In accordance with either the batch or semi-batch procedures, the vinyl acetate, ethylene, acrylate, any optional comonomers and the N-methylol containing monomer are polymerized in a aqueous medium under pressures not exceeding 100 atmospheres in the presence of a catalyst and at least one emulsifying agent, the aqueous system being maintained by a suitable buffering agent at a pH of 2 to 6, the catalyst being added incrementally or continuously. If a batch process is used, the vinyl acetate and the acrylate components are suspended in water and are thoroughly agitated in the presence of ethylene under the working pressure to effect solution of the ethylene in the vinyl acetate and acrylate up to the substantial limit of its solubility under the condition existing in the reaction zone, while the vinyl acetate and acrylate are gradually heated to polymerization temperature. The homogenization period is followed by a polymerization period during which the catalyst, which consists of a main catalyst or initiator, and may include an activator, is added incrementally or continuously together with the N-methylol containing monomer and any optional carboxylic acid, the pressure in the system being maintained substantially constant by application of a constant ethylene pressure if required. The semi-batch process is similar but some or all of the acrylate component is pre-emulsified with the N-methylol containing monomer and then added incrementally or continuously as the polymerization proceeds. In the case of the slow addition, some of the vinyl acetate is charged initially, and the remainder pre-emulsified with the N-methylol component and comonomers and added incrementally.

Suitable as polymerization catalysts are the water-soluble free-radical-formers generally used in emulsion polymerization, such as hydrogen peroxide, sodium persulfate, potassium persulfate and ammonium persulfate, as well as tert-butyl hydroperoxide, in amounts of between 0.01 and 3% by weight, preferably 0.01 and 1% by weight based on the total amount of the emulsion. They can be used alone or together with reducing agents such as sodium formaldehyde-sulfoxylate, iron-II-salts, sodium dithionite, sodium hydrogen sulfite, sodium sulfite, sodium thiosulfate, as redox catalysts in amounts of 0.01 to 3% by weight, preferably 0.01 to 1% by weight, based on the total amount of the emulsion. The free-radical-formers can be charged in the aqueous emulsifier solution or be added during the polymerization in doses.

The polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkai metal phosphates. Polymerization regulators, like mercaptans, aldehydes, chloroform, methylene chloride and trichloroethylene, can also be added in some cases.

The dispersing agents are all the emulsifiers generally used in emulsion polymerization, as well as optionally present protective colloids. It is also possible to use emulsifiers alone or in mixtures with protective colloids.

The emulsifiers can be anionic, cationic or non-ionic surface active compounds. Suitable anionic emulsifiers are, for example, alkyl sulfonates, alkylaryl sulfonates, alkyl sulfates, sulfates of hydroxylalkanols, alkyl and alkylaryl disulfonates, sulfonated fatty acids, sulfates and phosphates of polyethoxylated alkanols and alkylphenols, as well as esters of sulfosuccinic acid. Suitable cationic emulsifiers are, for example, alkyl quaternary ammonium salts, and alkyl quaternary phosphonium salts. Examples of suitable non-ionic emulsifiers are the addition products of 5 to 50 mols of ethylene oxide adducted to straight-chained or branch-chained alkanols with 6 to 22 carbon atoms, or alkylphenols, or higher fatty acids, or higher fatty acid amides, or primary and secondary higher alkyl amines; as well as block copolymers of propylene oxide with ethylene oxide and mixtures thereof. Preferably nonionic and/or anionic emulsifiers are used as emulsifying agents in amounts of 1 to 6% by weight of the polymerisate.

Suitable protective colloids optionally employed are partially or completely saponified polyvinyl alcohol with degrees of hydrolysis between 75 and 100% and viscosities of between 3 and 48 cps, measured as a 4% aqueous solution at 20° C.; water-soluble cellulose ether derivatives, like hydroxyethyl cellulose, hydroxypropyl cellulose methylcellulose or carboxymethyl cellulose; water-soluble starch ethers; polyacrylic acid or water-soluble polyacrylic acid copolymers with acrylamide and/or alkyl acrylates; poly-N-vinyl compounds of open-chained or cyclic carboxylic acid amides; and mixtures thereof.

The copolymers according to the invention have a glass transition temperature of between −45° to −20° C. and dry to form soft flexible films. They are generally crosslinked in a weakly acid pH range or in the presence of latent acid catalysts at elevated temperature. The optimum crosslinking temperatures are between 100° and 200° C., preferably between 130° and 160° C. Acid catalysts accelerate the crosslinking. Such acid catalysts are mineral acids or organic acids, such as phosphoric acid, tartaric acid, citric acid, or acid salts, such as chromium-III salts, aluminum chloride, ammonium chloride, zinc nitrate or magnesium chloride.

The process of making the vinyl acetate-ethylene-acrylate-N-methylol containing interpolymer latices generally comprises the preparation of an aqueous solution containing at least some of the emulsifying agent and stabilizer, and the pH buffering system. This aqueous solution and the initial charge of vinyl acetate are added to the polymerization vessel and ethylene pressure is applied to the desired value. The quantity of ethylene entering into the copolymer is influenced by the pressure, the agitation, and the viscosity of the polymerization medium. Thus, to increase the ethylene content of the copolymer, higher pressures are employed. A pressure of at least about 10 atmospheres is most suitably employed. As previously mentioned, the mixture is thoroughly agitated to dissolve the ethylene, agitation being continued until substantial equilibrium is achieved. This generally requires about 15 minutes. However, less time may be required depending upon the vessel, the efficiency of agitation, the specific system, and the like. When high ethylene contents are desired, a higher degree of agitation should be employed. In any case, by measuring the pressure drop of the ethylene in conventional manner, the realization of substantial equilibrium can be easily determined. Conveniently the charge is brought to polymerization temperature during this agitation period. Agitation can be effected by shaking, by means of an agitator, or other known mechanism. The polymerization is then initiated by introducing initial amounts of the catalyst, and of the activator when used. After polymerization has started, the catalyst and the activator are incrementally added as required to continue polymerization, and the N-methylol containing monomer and in the case of the semi-batch process, the acrylates are similarly added.

As mentioned, the reaction is generally continued until the residual vinyl acetate, acrylate and N-methylol monomer content is below about 1%. The completed reaction product is then allowed to cool to about room temperature, while sealed from the atmosphere.

By following the procedure described above, particularly the initial saturation of the polymerization mixture with ethylene before polymerization is initiated, there can be produced the stable vinyl acetate-ethylene-acrylate-N-methylol containing interpolymer latex characterized above, with the copolymer having an ethylene content of 10 to 30%, an intrinsic viscosity of 1 to 2.5 dl./g. (measured in dimethyl formamide) and an average particle size of 0.1 to 2 microns, with the latex having a high solids content of up to 60% or more.

The vinyl acetate-ethylene-acrylate-N-methylol containing backcoating described above is suitably used to prepare woven pile fabrics by a variety of methods known to the art which, in general, involve the impregnation of a loosely assembled web of fibers which remain after cutting of the woven tufts to form the pile, followed by moderate heating to dry the web and cure the coating. The specific composition of the backcoating formulation as well as the method of application varies depending upon the type of fabric to be coated and the end use thereof.

Backcoatings formulated for pile upholstery fabrics are usually utilized at relatively high solids levels and are generally combined with substantial amounts of inert fillers such as clay, aluminum hydrate, silica, calcium carbonate, etc. These fillers are employed in amounts up to about 150 parts by weight per 100 parts of the dry binder to which remain after cutting of the woven tufts to form the pile, provide a viscosity of about 5,000 to 10,000 cps. These pile upholstery binders may also have incorporated therein an N-methylol containing thermoset polymer to improve the strength of the overall binder. This may be accomplished by replacing 0.5 to 5% by weight of the latex binder solids with an N-methylol containing thermoset polymer. Suitable polymers are represented by the following formula

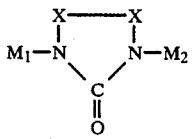

(I)

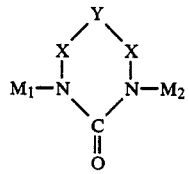

(II)

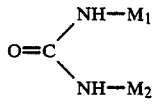

(III)

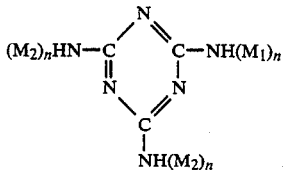

(IV)

wherein (a) X is $>CH_2$ or $>CHOH$;

(b) X—X can be

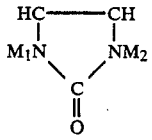

(c) Y is $>CH_2$ or $RN<$ wherein R is lower alkyl or hydroxy lower lower alkyl:

(d) $M_1$ is $—CH_2OH$;

(e) each of $M_2$ and $M_3$ is H or a $—CH_2OR^1$ group wherein $R^1$ is a lower alkyl group and n is 1 or 2.

Typical examples of these thermoset polymers are monoethylolmelamine, dimethylolmelamine, trimethylolmelamine, tetramethylolmelamine, pentamethylolmelamine, hexamethylolmelamine, N-methoxymethyl N'-methylolmelamine, dimethylolethylene urea, monomethylol urea, dimethylol urea, dimethylolethyltriazone, dimethylolhydroxyethyltriazone, tetramethylolacetylene diurea, dimethylolpropylene urea, dimethyloldihydroxyethylene urea, N-butoxymethyl N-methylol urea and N-methoxymethyl N-methylol urea.

In the situation where the upholstery binders are to be applied utilizing foaming techniques, they are adjusted to an alkaline pH and foaming agents added hereto. The foaming agents which may be used herein are generally the water soluble salts of aliphatic carboxyic acids containing 16 to 20 carbon atoms, preferably those of the 18 carbon atom acids, representative of which are the alkali metal, ammonium or amine salts of stearic acid, tallow fatty acids and oleic acid. Most commonly employed is ammonium stearate. The foaming agents, if used, are present in amounts of 1 to 10%, preferably 2 to 8%, by weight of the adhesive solids.

The binders disclosed herein may also be used in the manufacture of corduroy where the pile retention, strength requirements, abrasion resistance, and wash durability are high yet a soft hand is desired. Binders for use in corduroy pile fabrics, are generally diluted with water and utilized at about 20 to 30% solids levels. When used in this application, fillers are not present, however other known additives including permanent press resins, softeners, etc. are commonly employed.

Additionally, there may also be present in any of the latex binders of the invention other additives conventionally employed in similar binders including auxiliary foaming agents, foam stabilizers, defoamers, pigments, catalysts, wetting agents, thickeners, external plasticizers, etc. The choice of materials as well as the amounts employed are well known to those skilled in the art. These materials may be added just before application, if their stability in the dispersion or solution is low, or they may be formulated into the aqueous dispersion of the binder and stored if the stability in aqueous dispersion is high. Further, before these binders are applied they are optionally mixed with a suitable catalyst for the N-methylol groups.

Thus, acid catalysts such as mineral acids, e.g. HCl, or organic acids, e.g., oxalic acid, or acid salts such as ammonium chloride, are suitably used, as known in the art. The amount of catalyst is generally about 0.5 to 2% of the total resin.

As previously discussed, the latex binders of the invention may be readily applied to a woven fabric to provide a backcoating or similar coating which will give a balance of softness and strength characteristics to the fabric, particularly in the areas of pile retention and abrasion resistance. In the case of the foamable latices, the preferred method for application is via knife coating after which the latex is partially dried and may, or may not, be crushed depending on the end use of the coated fabric. Foamed techniques are more commonly utilized in binders formulated for pile upholstery fabrics while kiss coating techniques involving passing the fabric over a roller in a binder bath is generally used for corduroy.

The backcoatings may be applied to woven fabrics formed from a wide range of natural or synthetic fibers including cotton, wool, linen, cellulose acetate, nylon, rayon, polyester and mixtures thereof. The rate of application can be readily controlled in known manner and the quantity applied to the fabric will depend upon individual conditions and the individual fabric being treated. Ordinarily, for use as a backcoating for pile upholstery, the latex is applied at such a rate that the solids content of the coating is of the order of 5–6% based on the weight of the fabric while for corduroy finishes, add-on binder levels of 2.5 to 10% of the dry weight of the fabric are used. The solids content of the latex itself can also vary, but it is generally advantageous to have a solids content of the order of 50% for upholstery and 10–20% for corduroy. If the latex, as produced, has a higher solids content, or if an even lower solids content is desired, the appropriate solids content can readily be attained by appropriate dilution of the latex with water.

After the coating has been applied, the fabric is subjected to a drying stage and a curing stage. The drying is ordinarily carried out at a temperature in the range of 150° to 155° C. for a period of time of the order of 3 minutes. However, other time-temperature relationship can be employed, as is well known in the art, shorter times at higher temperatures or longer times at lower temperatures being used. For example, the curing step can be carried out at 140° C. for about 15 min. or more. However, economic considerations make the use of excessively long times undesirable, and the upper temperature limit is governed by the nature of the fabric. Temperatures which degrade the fabric are, of course, avoided. If the fabrics are heat resistant, temperatures as high as 175° C. or higher can be used with times of 5–10 min. or more. If desired, the drying and curing can be effected in a single exposure or step, e.g. at 150° C. for 5–10 min. In the curing, the N-methylol acrylamide completes its polymerization and cross-links in the resin. To facilitate this post-polymerization, the latex has mixed with it, before it is applied to fabric, a suitable catalyst for the N-methylol acrylamide. Thus, acid catalysts such as mineral acids, e.g. HCl, or organic acids, e.g. oxalic acid, or acid salts such as ammonium chloride or magnesium chloride are suitable used, as known in the art. The amount of catalyst is generally about 0.5 to 2% of the total resin.

The following examples are given to illustrate the present invention, but it will be understood that they are intended to be illustrative only and not limitative of the invention. In the examples, all parts are by weight unless otherwise indicated.

EXAMPLE I

This example describes the semi-batch preparation of the emulsion polymers utilized as a base for the backcoatings in accordance with the present invention.

A 10 liter stainless steel autoclave equipped with heating/cooling means, variable rate stirrer and means for metering monomers and initiators was employed. To the 10 liter autoclave was chrged 450 g (of a 20% w/w solution) sodium alkyl aryl polyethylene oxide sulphate (3 moles ethylene oxide), 40 g (of a 70% w/w solution in water) alkyl aryl polyethylene oxide (30 mole ethylene oxide), 90 g (of a 25% w/w solution in water) sodium vinyl sulphonate, 2 g sodium formaldehyde sulphoxylate, 0.5 g sodium acetate, 5 g (of a 1% solution in water) ferrous sulphate solution and 2500 g water. After purging with nitrogen all the vinyl acetate (2800 g) was added and the reactor was pressurized to 750 psi with ethylene and equilibrated at 50° C. for 15 minutes.

The polymerization was started by metering in a solution of 25 g. tertiary butyl hydroperoxide in 250 g of water and 25 g sodium formaldehyde sulphoxylate in 250 g of water. The initiators were added at a uniform rate over a period of 5¼ hours.

Concurrently added with the initiators over a period of 4 hrs was a pre-emulsified blend of 1200 g 2-ethylhexyl acrylate and 150 g N-methylol acrylamide (48% w/w solution in water) in a solution of 450 g (of a 20% w/w solution in water) sodium alkyl aryl polethylene oxide sulphate (3 mole ethylene oxide), 25 g (of a 70% w/w solution in water) alkyl aryl polyethylene oxide (30 mole ethylene oxide) and 1 g sodium acetate in 400 g water.

During the polymerization, the temperature of the reaction was maintained at 55°–60° C. by means of cooling and at the end of the reaction, the emulsion was transferred to an evacuated vessel (30 liter) to remove residual ethylene from the system. Composition and analysis of the latex are given in Tables 1 and II.

EXAMPLE 2

Emulsions 2, 3, 4, 6 and 7 were prepared following the procedures of Example 1, but varying the amounts and components of the charges and utilizing additional comonomers. Composition and analysis of the latices are also given in Tables I and II.

EXAMPLE 3

The following example utilizes the slow addition technique to prepare an emulsion polymer for use in the backcoatings of the invention.

To the 10 liter autoclave was charged 90 g. (of a 20% w/w solution in water) sodium alkyl aryl polyethylene oxide sulphate (3 moles ethylene oxide), 6 g (of a 70% w/w solution in water) alkyl aryl polyethylene oxide (30 mole ethylene oxide), 20 g (of a 25% w/w solution in water) sodium vinyl sulphonate, 2 g sodium formaldehyde sulphoxylate, 0.5 g sodium acetate, 5 g (of a 1% w/w solution in water) ferrous sulphate solution and 2000 g water. After purging with nitrogen, 300 g vinyl acetate and 100 g butyl acrylate was charged to the reactor. The reactor was then pressurized to 750 psi with ethylene and equilibrated at 50° C. for 15 minutes. The polymerization was started by metering in a solution of 35 g tertiary butyl hydroperoxide in 250 g water and 35 g sodium formaldehyde sulphoxylate in 250 g water over a period of 6½ hours.

Concurrently added with the initiators over a period of 4 hrs was a pre-emulsified blend of 1900 g butyl acrylate, 1700 g. vinyl acetate, 150 g. (48% w/w solution in water) N-methylol acrylamide, 810 g. (of a 20% w/w solution in water) sodium alkyl aryl polyethylene oxide sulphate (3 mole ethylene oxide), 60 g. (of a 70% w/w solution in water) alkyl aryl polyethylene oxide (30 mole ethylene oxide), 1 g. sodium acetate, 60 g. (of a 25% w/w solution in water) sodium vinyl sulphonate in 600 g. water.

During the polymerization, the temperature of the reaction was maintained at 55°-60° C. by means of cooling and the pressure at 750 psi of ethylene by adding it when necessary. At the end of the additions of monomers and catalysts, the emulsion was transferred to an evacuated vessel following the procedure in Ex. 1 and is designated Emulsion 5 in Tables I and II.

TABLE I

| | (Composition) | | | | | | |
|---|---|---|---|---|---|---|---|
| Emulsion | VA | 2-EHA | BA | E | NMA | Other Monomers | Procedure |
| 1 | 51 | 34 | — | 15 | 1.5 | — | semi-batch |
| 2 | 42.5 | — | 42.5 | 15 | 4.0 | 2 parts methacrylic acid | semi-batch |
| 3 | 42.5 | — | 42.5 | 15 | 4.0 | 2 parts acrylic acid | semi-batch |
| 4 | 42.5 | — | 42.5 | 15 | 4.0 | 2 parts acrylic acid and 0.2 parts allyl methacrylate | semi-batch |
| 5 | 42.5 | — | 42.5 | 15 | 1.5 | — | slow add |
| 6 | 42.5 | — | 42.5 | 15 | 1.5 | — | semi-batch |
| 7 | 42.5 | — | 42.5 | 15 | 3.0 | — | semi-batch |

VA = Vinyl acetate
2-EHA = 2-ethylhexyl acrylate
BA = Butyl acrylate
E = Ethylene
NMA = N—methylol acrylamide

TABLE II

| | (Physical Properties) | | | | | |
|---|---|---|---|---|---|---|
| Emulsion | % Solids | pH | Viscosity | Particle Size (Microns) | IV (DMF) | Tg (°C.) |
| 1 | 50.2 | 5.0 | 150 | 0.31 | 0.81 | −33 |
| 2 | 51.7 | 3.7 | 350 | 0.24 | 1.93 | −24 |
| 3 | 51.7 | 3.4 | 375 | 0.24 | 1.59 | −24 |
| 4 | 51.2 | 3.6 | 545 | 0.25 | 0.54 | −23 |
| 5 | 50.8 | 4.1 | 130 | 0.27 | 0.85 | −31 |
| 6 | 52.2 | 3.7 | 60 | 0.30 | 1.61 | −23 |
| 7 | 48.2 | 4.2 | 50 | 0.43 | 1.20 | −27 |

The latex binder designated Emulsion 6 was compounded at 60 and 40 parts filler into upholstery backcoatings using the formulation shown below:

| | Parts by Weight | | | |
|---|---|---|---|---|
| Ingredients | A | B | C | D |
| Emulsion 6 @ 50% Solids | 200.0 | 200.0 | 200.0 | 200.0 |
| Defoamer | 4 drops | 4 drops | 4 drops | 4 drops |
| Calcium Carbonate Filler | 60.0 | 40.0 | 60.0 | 40.0 |
| Water | 79.0 | 61.0 | 82.6 | 58.3 |
| Dispersant | 2.0 | 1.3 | 2.0 | 1.3 |
| Plasticizer | — | — | 1.0 | 1.0 |
| Acrylate Thickener | 31.9 | 30.7 | 34.0 | 29.6 |
| Ammonia (26%) | 3.3 | 4.7 | 4.4 | 3.7 |

The backcoatings were then coated on tufted upholstery fabrics at add-on levels of about 4 ounces per square yard and dried/cured for 5 minutes at 150° C. The coated fabrics at similar add-on levels were tested using the following procedures:

Softness: Softness or hand of a fabric is difficult to test using quantitative techniques. There is a correlation between softness of the fabric and Tg of the binder system, however since $T_g$ is the temperature at which the polymer changes from a glassy to a rubbery state (which for soft binder is generally in the range of −20° C. to −35° C. or lower), neither measured Tg nor calculated Tg is a completely adequate measure of the perceived softness of a binder at ambient conditions. Nonetheless, for binders using the same class of comonomers, for example, vinyl acrylic binders, ethylene-vinyl acetate binders, etc., the lower the $T_g$ of the coolymer, the greater the softness of the fabric coated therewith.

In the case of the samples tested herein, a panel test was also run to determine the relative softness by rating the samples in order of softest to firmest by feeling the drape and pliability of the samples. The softest sample was rated as 1, the next a 2, etc., for the total numbers tested. The results reported show the average of two or three panelist ratings for each sample.

Tabor Abrasion Test: The purpose of the test is to determine the durability of the back coating to an abrasion or rubbing type action. The test was conducted by mounting samples with the back of the fabric facing up and then subjecting them to 100 cycles using H-18 wheels. The number of tufts removed by this abrasive action indicates the relative toughness or durability of the back coating. The actual number of lost tufts were counted; therefore, lower number indicate better durability performance.

Pluck Strength: The pluck strength test measures the amount of force required to remove a single tuft from the fabric. A Kelly Clamp is used to secure a single tuft which is then connected to a hand held scale for measuring the force required to remove the tuft.

Seam Slippage: The purpose of this test is to determine the stress in pounds required to cause a slippage of ¼" or ⅛" for the coated fabric. A test similar to AST D4034-81 was used and results are recorded in pounds per square inch. Numbers followed by + indicate breakage of the fibers occurred before the ¼" of slippage was obtained.

The results of the testing are shown in Tables III and IV. For comparative purposes, test results obtained using a commercial all acrylic binder are also given.

TABLE III

| | A | B | C | D |
|---|---|---|---|---|
| Initial pH/(cps) | 8.3/7,500 | 8.3/9,800 | 8.2/7,050 | 8.1/7,660 |
| 3 Day pH/(cps) | 7.8/6,550 | 8.0/11,800 | 7.8/6,550 | 7.8/8,100 |
| 5 Day pH/(cps) | 7.8/5,600 | 7.9/11,900 | 7.8/6,200 | 7.7/7,750 |
| 1 Week pH/(cps) | 7.8/5,680 | 7.9/11,900 | 7.8/5,170 | 7.7/6,980 |

TABLE IV

| Composition of Compound | Taber (no tufts removed) | Pluck (lbs) | Seam Slippage (lbs) ¼ Warp | ¼ Fill | ⅛ Warp | ⅛ Fill | Hand 1 = best 5 = worst |
|---|---|---|---|---|---|---|---|
| 60 Parts Filler No Plasticizer | 54 (good) | .53 | 115+ | 76+ | 84 | 66 | 5 |
| 40 Parts Filler No Plasticizer | 105 (fair) | .44 | 99+ | 74+ | 70 | 62 | 3 |
| 60 Parts Filler 1% Plasticizer | 51 (good) | .48 | 101+ | 70+ | 74 | 42 | 4 |
| 40 Parts Filler 1% Plasticizer | 17 (ex.) | .59 | 109+ | 64 | 86 | 36 | 2 |
| Acrylic Control | 145 | .34 | 87+ | 54 | 76 | 26 | 1 |

Table III shows the pH and viscosity change over time and illustrates the excellent compound stability of backcoating formulations containing the emulsion polymers disclosed herein. The results of the tests of Table IV show the ethylene vinyl acetate/acrylate binders of the invention give superior pluck strength, abrasion resistance and seam slippage compared to the acrylic control. While the acrylic control was the softest in hand of all the binders sampled, the maximum balance in the contradictory properties of softness and strength is obtained using the binders of the invention.

In order to further illustrate these advantages, another series of tests were run in which the binder of Emulsion 6 was compared with all acrylic binders prepared from blends in varying proportions of two acrylic binders, Binder A as having a $T_g$ of −35 and Binder B having a $T_g$ of −10. The formulation utilized in this test is shown below with testing results in Table V.

| Ingredients | Parts by Weight |
|---|---|
| Latex or latex blend @ 49.2% | 300.0 |
| Water | 17.0 |
| Dispersant | 0.8 |
| Defoamer | 0.5 |
| Calcium Carbonate Filler | 115.0 |
| Acid Catalyst (20%) | 8.0 |
| Acrylate Thickeners | 10.0–22.0 |
| 28% Ammonia | 2.3–5.0 |

TABLE V

| | Emulsion 6 | A/B 90/10 | A/B 70/30 | A/B 50/50 | A/B 30/70 | A/B 10/90 |
|---|---|---|---|---|---|---|
| Add-on | 4.3 oz/yd$^2$ | 4.3 oz/yd$^2$ | 4.2 oz/yd$^2$ | 4.2 oz/yd$^2$ | 4.1 oz/yd$^2$ | 4.2 oz/yd$^2$ |
| Hand | 1.5 | 1 | 2 | 3 | 4 | 5 |
| Taber | 24 | 89 | 71 | 30 | 49 | 13 |
| Pluck | .40 lbs | .25 lbs | .27 lbs | .26 lbs | .32 lbs | .42 lbs |

As the results show, previous prior art attempts to increase the strength properties of the binders by adding larger amounts of relatively high $T_g$ acrylic monomers, resulted in a significant increase in stiffness (see the blend of 10% A and 90% B). In contrast, the formulations of the present invention achieve a hand almost as soft as the 90% A/10% B blend with strength properties close to those of the 10% A/90% B blend.

Emulsions 1–7 were evaluated as a backcoating for corduroy using the following formulation:

| Ingredients | Parts by Weight (Wet) |
|---|---|
| Polymer @ 50% Solids | 150.0 |
| Acid Catalyst | 10.0 |
| Wetting Agent | 2.0 |

-continued

| Ingredients | Parts by Weight (Wet) |
|---|---|
| Water | 838.0 |
| Total | 1,000.0 |

The backcoatings were coated on the corduroy at wet pickup levels of 60%, dried for 1 minute at 175° C. and cured for 2 minutes at 150° C. The coated fabric was then tested using the following procedures.

Pile Retention Testing: This test measures the ability of the backcoating to retail pile yarns during abrasive or rubbing type actions. A Tabor Abrasion Tester with a CS-10 wheel for 100, 300, 500, and 700 cycles was utilized. A rating of 5.0 is equal to no pile loss while a rating of 1.0 indicates complete pile loss. A rating 3.0 is considered average/satisfactory at 100 cycles with a rating of 4.0 desired. Samples were tested before and after three home laundering cycles.

% Fiber Loss: This test is used in conjunction with pile retention ratings to measure durability to abrasive/-rubbing type actions. Samples are weighed before and after abrasion testing with the weight loss divided by the original sample wt. times 100 as the % Fiber Loss.

The results of the testing are shown in Table VI.

TABLE VI

| Emulsion | Fiber % Loss | Pile Retention Ratings (Cycles) 100 | 300 | 500 | 700 | Hand |
|---|---|---|---|---|---|---|
| 1 | 0.93 | 4.5 | 4.5 | 4.0 | 3.5 | 3.5 |
| 2 | 0.07 | 5.0 | 5.0 | 5.0 | 5.0 | 2.5 |
| 3 | 0 | 5.0 | 5.0 | 5.0 | 5.0 | 3.0 |
| 4 | 0.13 | 5.0 | 5.0 | 5.0 | 5.0 | 2.5 |
| 5 | 1.37 | 4.5 | 3.5 | 3.0 | 2.5 | 3.0 |
| 6 | 2.10 | 5.0 | 3.0 | 2.5 | 2.0 | 2.5 |
| 7 | 0.04 | 5.0 | 5.0 | 5.0 | 4.5 | 3.0 |
| A | 0.30 | 5.0 | 4.5 | 4.5 | 4.5 | 4.0 |
| B | 0.95 | 5.0 | 4.5 | 4.0 | 3.0 | 4.0 |
| | | After 3 home laundry cycles: | | | | |
| 1 | 1.70 | 4.5 | 3.5 | 2.5 | 2.5 | 3.5 |
| 2 | 0.14 | 5.0 | 5.0 | 5.0 | 4.5 | 2.5 |
| 3 | 0.45 | 5.0 | 5.0 | 5.0 | 4.5 | 3.0 |
| 4 | 0.009 | 5.0 | 5.0 | 5.0 | 5.0 | 2.5 |
| 5 | 2.19 | 4.0 | 3.0 | 2.5 | 2.0 | 3.0 |
| 6 | 3.64 | 4.5 | 2.0 | 1.5 | 1.0 | 2.5 |
| 7 | 0.56 | 5.0 | 4.5 | 3.5 | 3.0 | 3.0 |
| A | 0.84 | 4.5 | 4.0 | 3.5 | 3.5 | 4.0 |

TABLE VI-continued

| Emulsion | Fiber % Loss | Pile Retention Ratings (Cycles) 100 | 300 | 500 | 700 | Hand |
|---|---|---|---|---|---|---|
| B | 1.46 | 4.0 | 2.5 | 2.0 | 1.5 | 4.0 |

A = Commercially used "soft" all acrylic (Tg = −25° C., NMA = 3)
B = Commercially used "soft" all-acrylic (Tg = −30° C. NMA = 3)

The results of Table VI show that the use of the emulsion of the present invention as backcoating in the production of corduroy pile fabrics provides generally equal or superior strength and durability properties as compared to the acrylic controls with only slight reduction in softness. Thus, Emulsion 1 provides equal durability as the acrylic controls with essentially the same softness while Emulsion 3 provides superior durability with only marginal reduction in softness. Additionally, a comparison of Emulsions 2, 3 and 4 versus Emulsion 6 and the controls demonstrates the advantages of higher levels of NMA in conjunction with acidic comonomers to provide optimum durability properties with Emulsion 4 showing the further benefits obtained by the presence of multi-functional monomer.

It will be apparent that various changes and modifications may be made in the embodiments of the invention described above, without departing from the scope of the invention, as defined in the appended claims, and it is intended therefore, that all matter ontained in the foregoing description shall be interpreted as illustrative only and not as limitative of the invention.

We claim:

1. A method for backcoating woven-pile fabrics having an extra set of warp or filling yarns interlaced with the fabric in such a manner that loops or cut ends are produced on the surface of the fabric which comprises the steps of:

(I) applying to the fabric an aqueous emulsion prepared by the emulsion polymerization of:

(a) a vinyl ester of an alkanoic acid having 1 to 13 carbon atoms interpolymerized with the following comonomers:

(b) 10 to 30% by a weight of ethylene;

(c) 30 to 50% by weight of a $C_4$–$C_8$ alkyl acrylate; and (d) 1 to 5% by weight of N-methylol acrylamide or N-methylol methacrylamide; the vinyl ester being added in an amount to total 100%; and (II) heating to dry the web and cure the backing.

2. The method of claim 1 wherein the vinyl ester in the emulsion is vinyl acetate.

3. The method of claim 1 wherein the olefinically unsaturated carboxylic acid is present in an amount of 1 to 2.5% by weight.

4. The method of claim 1 wherein the emulsion additionally contains an acid catalyst selected from the group consisting of mineral acids, organic acids and acid salts in an amount of 0.5 to 2% by weight of the emulsion polymer solids.

5. The method of claim 1 wherein the emulsion additionally contains 1 to 4% by weight of an olefinically unsaturated acid selected from the group consisting of acrylic acid, methacrylic acid, crotonic acid, itaconic acid, maleic acid and fumaric acid.

6. The method of claim 1 wherein the emulsion additionally contains 0.1 to 1% by weight of a polyethylenically unsaturated comonomer selected from the group consisting of vinyl crotonate, allyl acrylate, allyl methacrylate, diallyl maleate, divinyl adipate, diethyl adipate, dialkyl phthalate, ethylene glycol diacrylate, ethylene glycol dimethacrylate, butanediol dimethacrylate, methylene bis-acrylamide and triallyl cyanurate.

* * * * *

UNITED STATES PATENT AND TRADEMARK OFFICE

CERTIFICATE OF CORRECTION

PATENT NO. : 4,737,386

DATED : April 12, 1988

INVENTOR(S) : Wotier, et al.

It is certified that error appears in the above-identified patent and that said Letters Patent are hereby corrected as shown below:

Claim 3, line 1, "Claim 1" should read -- Claim 5 --.

Signed and Sealed this

Twenty-first Day of February, 1989

*Attest:*

DONALD J. QUIGG

*Attesting Officer*

*Commissioner of Patents and Trademarks*